US008894469B2

(12) United States Patent
Zhou et al.

(10) Patent No.: US 8,894,469 B2
(45) Date of Patent: Nov. 25, 2014

(54) SANDING MACHINE WITH CLAMPING MECHANISM

(75) Inventors: Hongtao Zhou, Nanjing (CN); Yasheng Chen, Nanjing (CN)

(73) Assignee: Chervon Limited, Hong Kong (HK)

( * ) Notice: Subject to any disclaimer, the term of this patent is extended or adjusted under 35 U.S.C. 154(b) by 294 days.

(21) Appl. No.: 12/845,922

(22) Filed: Jul. 29, 2010

(65) Prior Publication Data

US 2011/0028076 A1 Feb. 3, 2011

(30) Foreign Application Priority Data

Aug. 3, 2009 (CN) ..... 2009 2 0234018 U

(51) Int. Cl.
*B24B 23/04* (2006.01)
*B24D 15/02* (2006.01)

(52) U.S. Cl.
CPC ..... *B24B 23/04* (2013.01); *B24D 15/023* (2013.01)
USPC ..... 451/356; 451/516; 451/517

(58) Field of Classification Search
USPC ..... 451/356, 514–518; 24/24, 170, 71 R, 24/68 A
See application file for complete search history.

(56) References Cited

U.S. PATENT DOCUMENTS

| | | | | |
|---|---|---|---|---|
| 2,242,545 | A * | 5/1941 | Randolph | 451/516 |
| 2,282,043 | A * | 5/1942 | Ekstrom | 451/516 |
| 2,475,476 | A * | 7/1949 | Champayne | 451/516 |
| 2,546,087 | A | 3/1951 | Burleigh | |
| 2,712,206 | A * | 7/1955 | Champayne | 451/491 |
| 2,749,679 | A * | 6/1956 | Anton | 451/518 |
| 2,848,850 | A * | 8/1958 | Metoff | 451/344 |
| 4,077,165 | A * | 3/1978 | Hutchins | 451/518 |
| 4,475,317 | A | 10/1984 | Dicke | |
| 6,857,948 | B2 | 2/2005 | Bocka et al. | |
| 2001/0039696 | A1 * | 11/2001 | Maciejczyk | 24/170 |
| 2003/0019080 | A1 * | 1/2003 | Anthony et al. | 24/68 R |
| 2005/0085172 | A1 * | 4/2005 | Gansel et al. | 451/356 |
| 2006/0172670 | A1 | 8/2006 | Gyoergy | |
| 2006/0246830 | A1 | 11/2006 | Kirschhoffer et al. | |
| 2008/0214098 | A1 * | 9/2008 | Prause et al. | 451/357 |

FOREIGN PATENT DOCUMENTS

| | | |
|---|---|---|
| DE | 10253006 | 5/2004 |
| GB | 2322582 A | 9/1998 |
| GB | 2402095 B | 6/2006 |

OTHER PUBLICATIONS

English Abstract of DE10253006, Espacenet, Sep. 4, 2012, 2 pgs.

* cited by examiner

*Primary Examiner* — Lee D Wilson
*Assistant Examiner* — Henry Hong
(74) *Attorney, Agent, or Firm* — Greenberg Traurig, LLP

(57) ABSTRACT

A burnishing element is clamped to a lower surface of a bottom plate of a sanding machine and placed into tension through use of a first clamping mechanism and a second clamping mechanism that are positioned at two ends of the bottom plate, respectively. At least one of the first and second clamping mechanisms has a clamping element and a tensioning element which is used for tensioning the burnishing element. The bottom plate has a clamping area. The ends of the burnishing element are supported on the clamping area when the burnishing element is in placed into tension by the tensioning element.

8 Claims, 7 Drawing Sheets

SANDING MACHINE WITH CLAMPING MECHANISM

RELATED APPLICATION

This application claims the benefit of CN 200920234018.2, filed on Aug. 3, 2009, the disclosure of which is incorporated herein by reference in its entirety.

BACKGROUND

The following generally relates to sanding machines and, more particularly, relates to a sanding machine having a mechanism for clamping a burnishing element such as sand paper.

Sanding machines are power tools which are commonly used to burnish the surface of a workpiece, particularly to make the surface smooth and even. Generally, a sanding machine comprises a housing and a bottom plate mounted thereunder. A motor is arranged in the housing and drives the bottom plate to move via a transmission mechanism. Both ends of the bottom plate are arranged with a clamping mechanism. A burnishing element, such as a sand paper, could be supported on the lower surface of the bottom plate where the sand paper is clamped by the two clamping mechanisms respectively positioned on both ends of the bottom plate. Thus, the sand paper can be moved along with the bottom plate so as to burnish the surface of the workpiece.

In order to improve the sanding efficiency and quality of sanding machines, a sand paper clamping mechanism with tensioning function is provided in the prior art. For example, U.S. Pat. No. 6,857,948 discloses this kind of the clamping mechanism, which is mounted on one end of the bottom plate and comprises an active jaw and a passive jaw. Both the active jaw and the passive jaw are pivotable together about a shaft in the end of the bottom plate. During mounting of the sand paper, one end of the sand paper is clamped firstly. Next, the other end of the sand paper is put into the clearance between the active jaw and the passive jaw. Then, the active jaw is pivoted to make it close toward the passive jaw so as to clamp the ends of the sand paper between the active and passive jaws. With a further pivoting of the active jaw, it will drive the passive jaw to pivot together. Thus, the end of the sand paper clamped between the two jaws will pivot about the shaft along with the jaws so that it moves away from the other end of the sand paper and is tensioned.

Although the above sand paper clamping mechanism adds a tensioning function it still suffers from at least one defect. For example, because the active and passive jaws of the above clamping mechanism are both mounted on the bottom plate in a movable manner, the vibration of the machine will cause the active and passive jaws to move, so that the clamping and tensioning force between the two jaws is weakened, thus resulting in the clamping and tensioning of the sand paper being unreliable.

SUMMARY

The following describes a sanding machine that overcomes the defects existing in the above prior art by providing a clamping mechanism whereby a burnishing element could be clamped and tensioned by the clamping mechanism in a more reliable manner.

More particularly, the sanding machine described hereinafter comprises a housing and a bottom plate mounted thereunder. A burnishing element can be supported on the lower surface of the bottom plate, and the two ends of the bottom plate are mounted with a first clamping mechanism and a second clamping mechanism for clamping the burnishing element respectively, wherein at least one of the first and second clamping mechanisms comprises a clamping element and a tensioning element used for tensioning the burnishing element. The bottom plate includes a clamping area, and the ends of the tensioned burnishing element are supported on the clamping area when the burnishing element is in a tensioned condition.

The clamping element and the tensioning element each performs its own function and acts respectively with the clamping area of the bottom plate to implement the clamping and the tensioning. When clamped and tensioned, the ends of the burnishing element are pressed tightly on the lower surface of the clamping area by the clamping element and the tensioning element. Due to the clamping area being a rigid element, the clamping area will not be moved by the vibration of the machine during the working of the sanding machine so as to make the clamping and tensioning of the burnishing element more reliable.

BRIEF DESCRIPTION OF THE DRAWINGS

This subject sanding machine will be further explained in detail with reference to the accompanying drawings in which.

DETAIL DESCRIPTION

Figure 1:
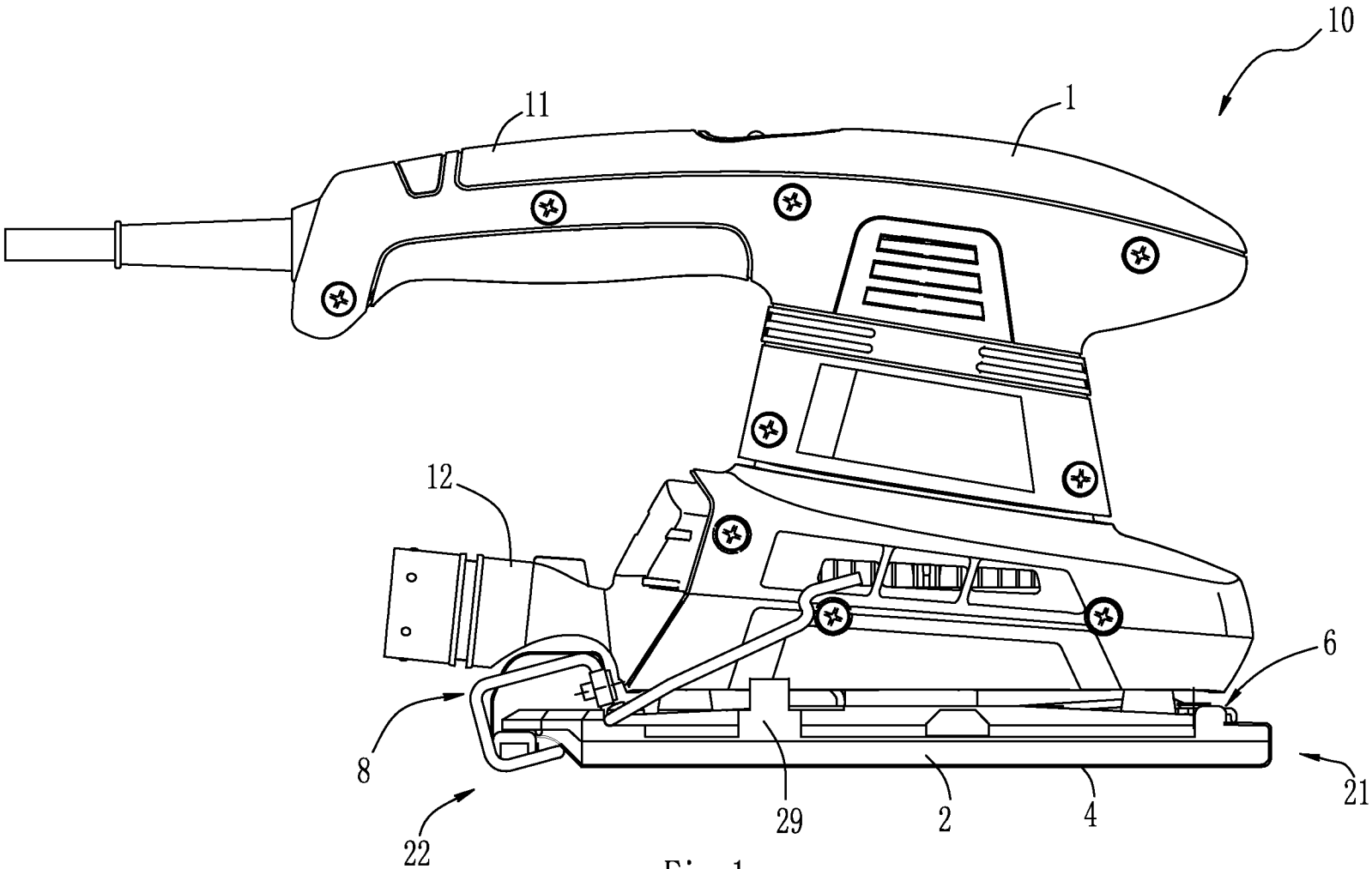
FIG. 1 is a schematic view of an exemplary sanding machine constructed according to the description that follows.

As shown in FIG. 1, a sanding machine 10 comprises a housing 1 and a bottom plate 2 mounted thereunder. A grasping portion or handle 11 is formed on the housing 1 and a dust outlet 12 is connected to the back lower portion of the housing 1. A motor (not shown) is mounted in the housing 1 and drives the bottom plate 2 to move via a power transmission mechanism. The first end 21 and the second end 22 of the bottom plate 2 are mounted with a first clamping mechanism 6 and a second clamping mechanism 8 respectively. A burnishing element 4, such as a sand paper, can be supported on the lower surface of the bottom plate 2 and both ends of the sand paper are clamped in the first and the second clamping mechanisms 6 and 8, respectively. Thus, the sand paper 4 moves together with the bottom plate 2 so as to burnish the surface of the workpiece.

Figure 2:
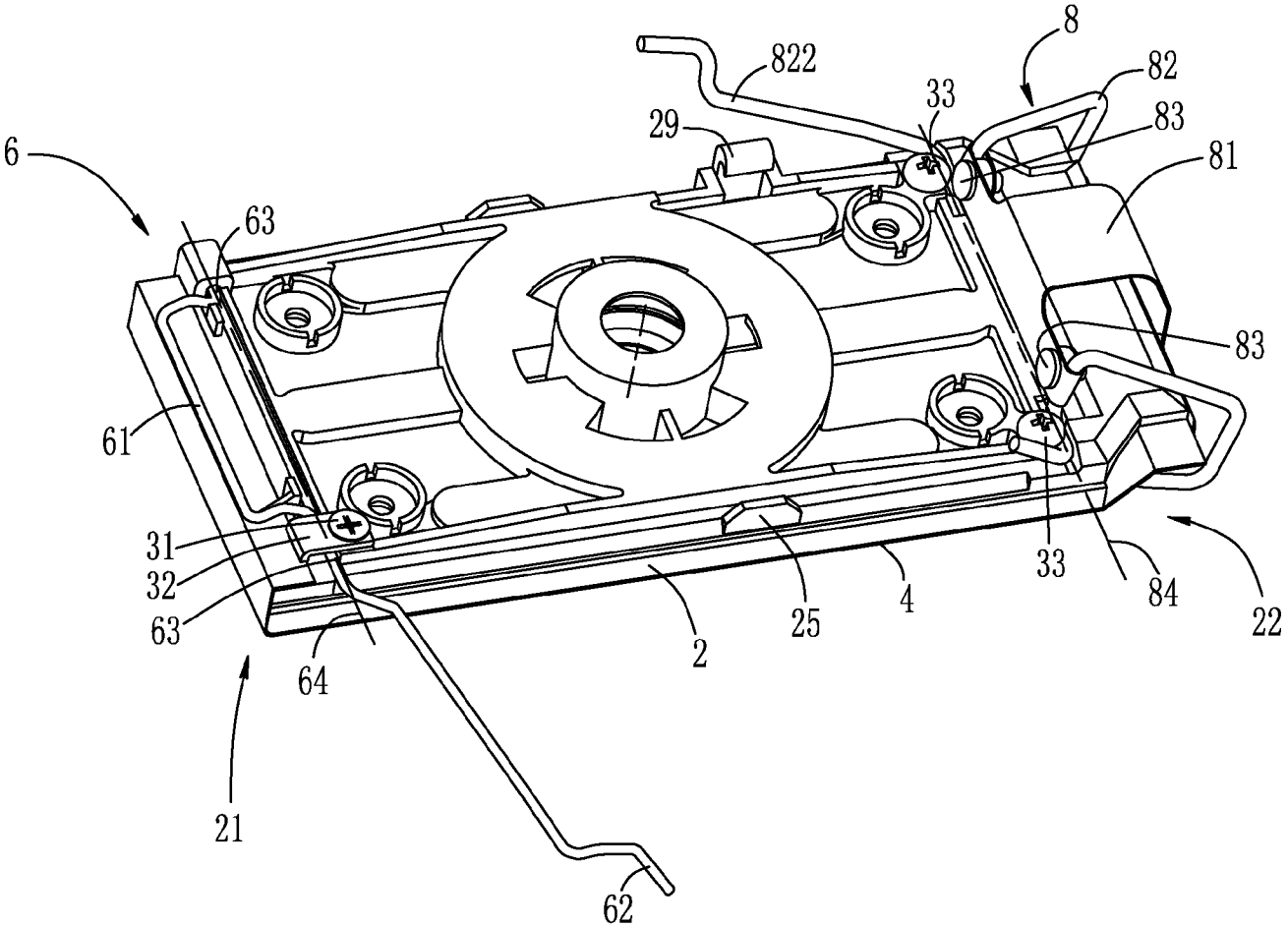
FIG. 2 is a schematic view of the bottom plate of the sanding machine of FIG. 1 particularly showing the first end and second end clamping mechanisms.
Figure 3:
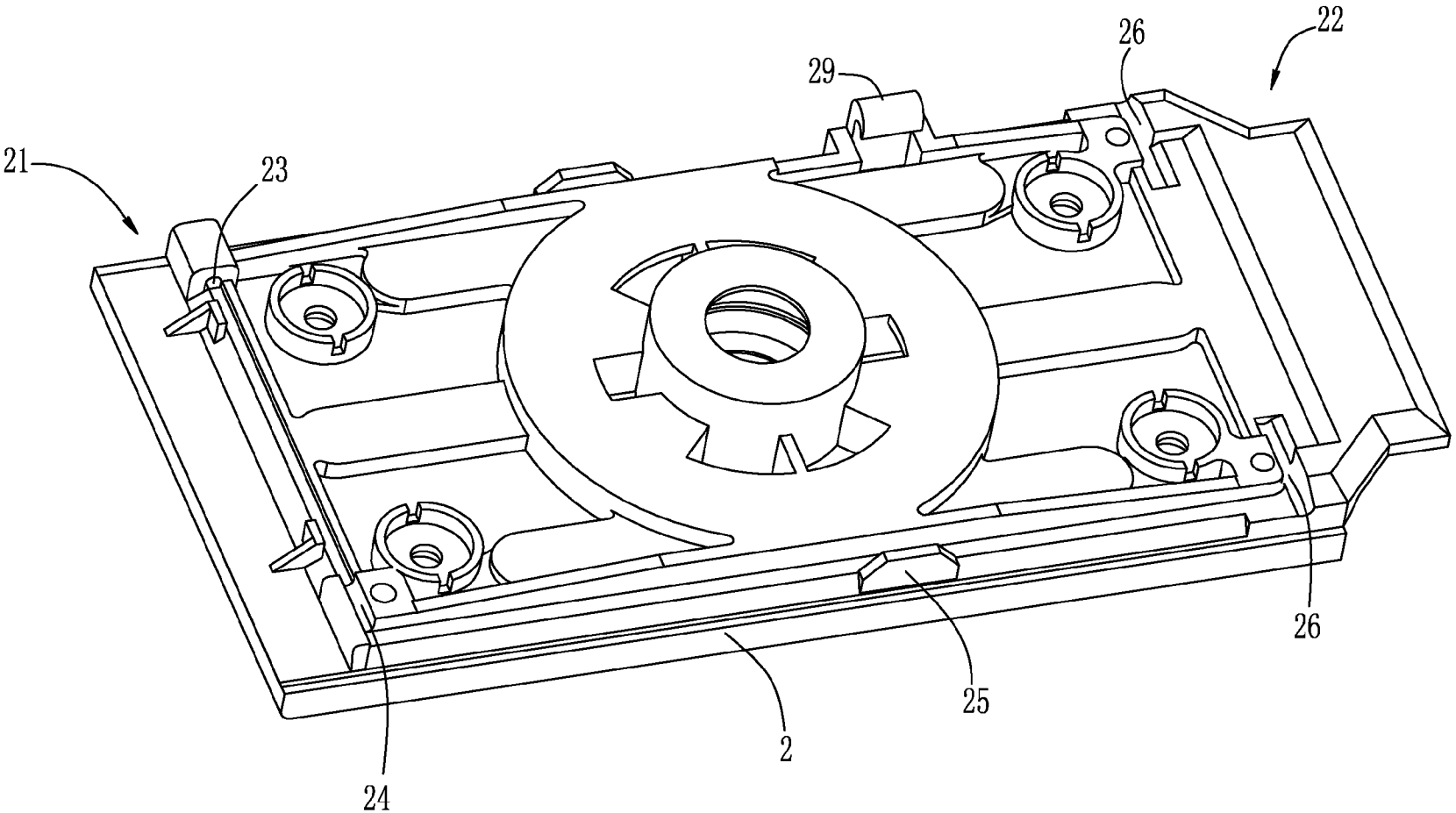
FIG. 3 is a schematic view of the bottom plate of FIG. 2, with the clamping mechanism removed.
Figure 5:
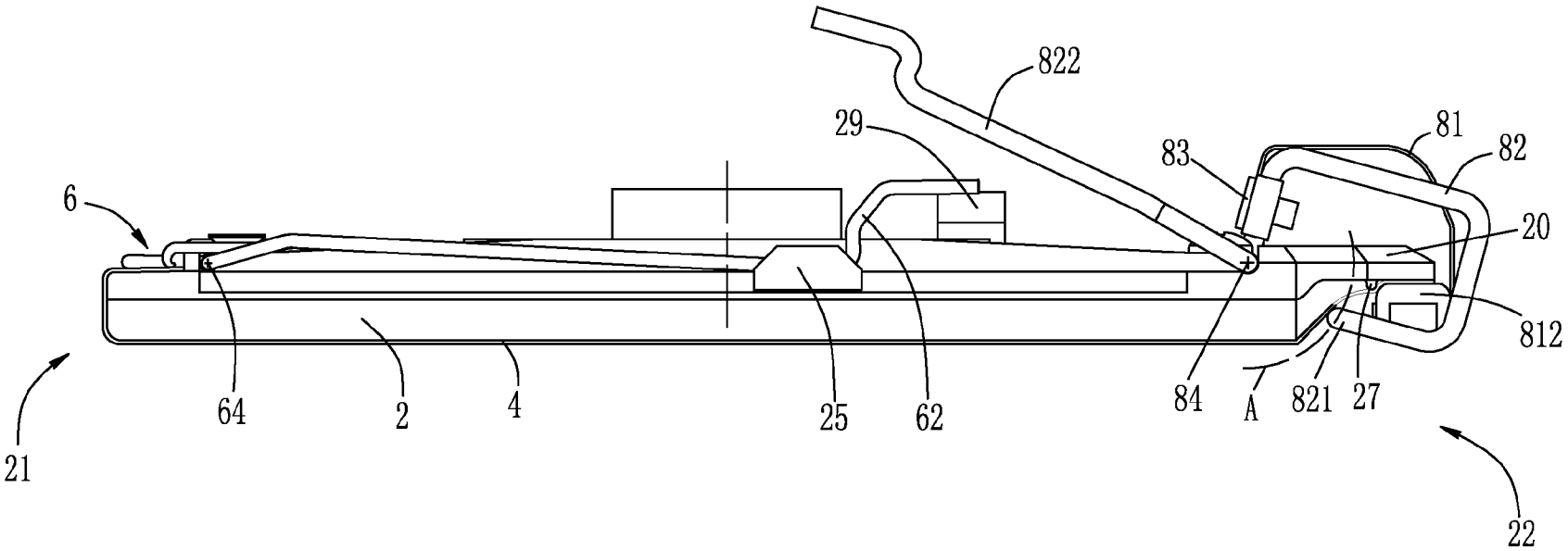
FIG. 5 is a schematic view illustrating the clamping mechanism of FIG. 2 in a clamping position.

As shown in FIG. 2, the first clamping mechanism 6 is a traditional clamping mechanism which is basically formed by a bent steel wire. The first clamping mechanism 6 comprises a first clamping portion 61, a first handle 62, and two first mounting portions 63 in the same line. As shown in FIGS. 2 and 3, the two first mounting portions 63 can be mounted into the bore 23 and the groove 24 in the first end 21 of the bottom plate, respectively, and fixed by the bolt 31 and the stop plate 32 so that the first clamping mechanism 6 is mounted onto the bottom plate 2. A first pivot axis 64 is formed by the two first supporting portions 63. The handle 62 is pivotable about the first pivot axis 64 between the clamping and releasing positions so as to drive the first clamping portion 61 to clamp or release the sand paper. In FIG. 2, the first clamping mechanism 6 is in the releasing condition, i.e., there is a clearance between the first clamping portion 61 and the first end 21 of the bottom plate and one end of the sand paper 4 could be inserted thereinto. In FIG. 5, the first clamping mechanism 6 is in the clamping condition, i.e., the first handle 62 is pivoted about the first pivot axis 64 to the position adjacent to the first locking block 25 on the bottom plate 2 where a first locking block 25 could maintain the first handle 62 in the clamping position.

The second clamping mechanism 8 comprises a clamping element 81 and a tensioning element 82. The tensioning element 82 is basically formed by a bent steel wire and the clamping element 81 is basically formed by a bent steel spring plate. The clamping element 81 is connected to the tensioning element 82 by two rivets 83. In other embodiments, the clamping element 81 could also be replaced by other materials having some flexibility.

Figure 4:
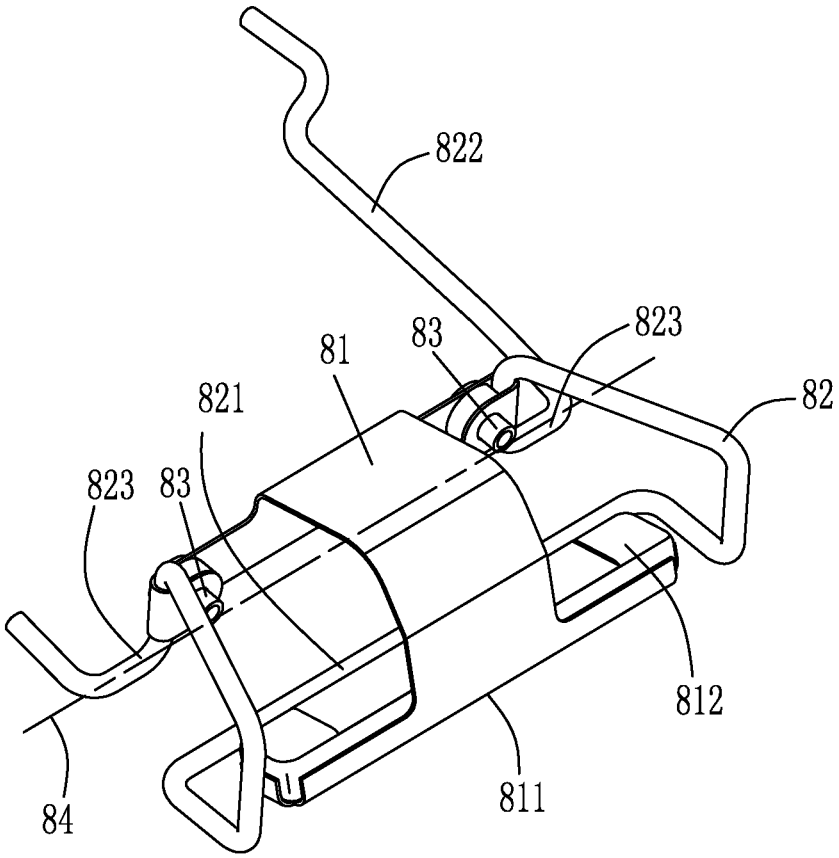
FIG. 4 is a schematic view of the second end clamping mechanism of FIG. 2.

As shown in FIG. 4, the tensioning element 82 comprises a tensioning portion 821, a second handle 822 and two second mounting portions 823 in the same line. The clamping element 81 comprises a second clamping portion 811 located outside of the tensioning portion 821. A rubber strip 812 is mounted on the second clamping portion 811 for contacting with the sand paper 4. In the clamping condition, the rubber strip 812 is pressed tightly on one end of the sand paper 4. As shown in FIGS. 2 and 3, the two second mounting portions 823 could be located in the two grooves 26 in the second end 22 of the bottom plate, respectively, and fixed by two bolts 33, so that the second clamping mechanism 8 is mounted on the bottom plate 2. A second pivot shaft axis 84 is formed by the two second mounting portions 823 together. The second handle 822 is pivotable about the second pivot shaft axis 84 to thereby drive the clamping element 81 and tensioning element 82 about the second pivot shaft axis 84 together between the clamping position and the releasing position. The bottom plate 2 is arranged with a second locking block 29 thereon for maintaining the second handle 822 in the clamping position.

Figure 6:
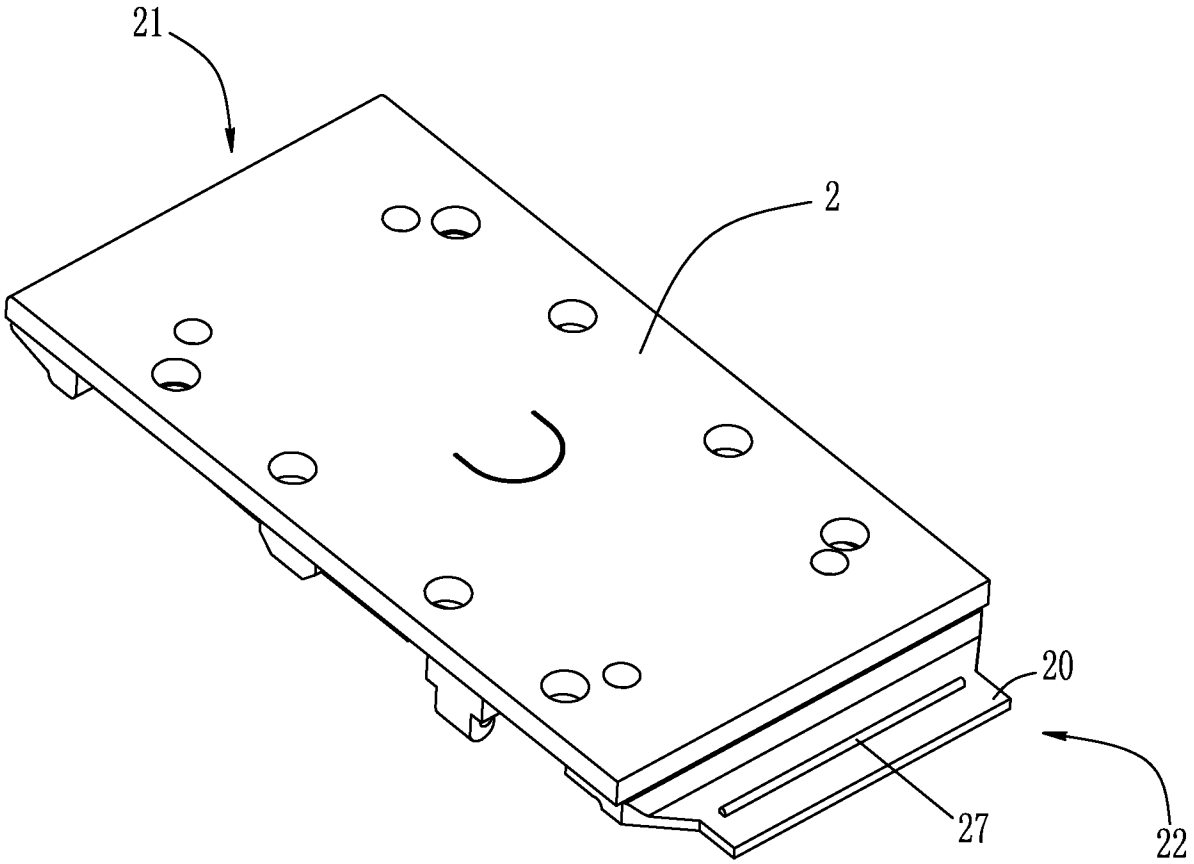
FIG. 6 is a bottom view of the bottom plate of FIG. 3.

As shown in FIGS. 5 and 6, the second end 22 of the bottom plate 2 is arranged with a clamping area 20 extending outwardly. The lower surface of the clamping area 20 is above the lower surface of the bottom plate 2. The clamping area 20 is arranged with a release-proof mechanism on its lower surface, which is a long-strip shaped projection 27 for preventing the clamped sand paper from releasing. In this embodiment, the clamping area 20 and the bottom plate 2 are formed integrally, while in other embodiments, the clamping area could also be a separate part which is connected to the bottom plate by a connection component.

During mounting of the sand paper 4, one end of the sand paper 4 is put into the clearance that is between the first clamping portion 61 of the first clamping mechanism 6 and the first end 21 of the bottom plate firstly. Then, the first handle 62 is pivoted about the first pivot shaft axis 64 so as to drive the first clamping portion 61 to pivot about the first pivot shaft axis 64, so that the end of the sand paper is clamped on the bottom plate 2. Finally, the first handle 62 is pivoted to the position adjacent to the first locking block 25 and maintained in this position, i.e. the condition shown in FIG. 5.

Figure 7:
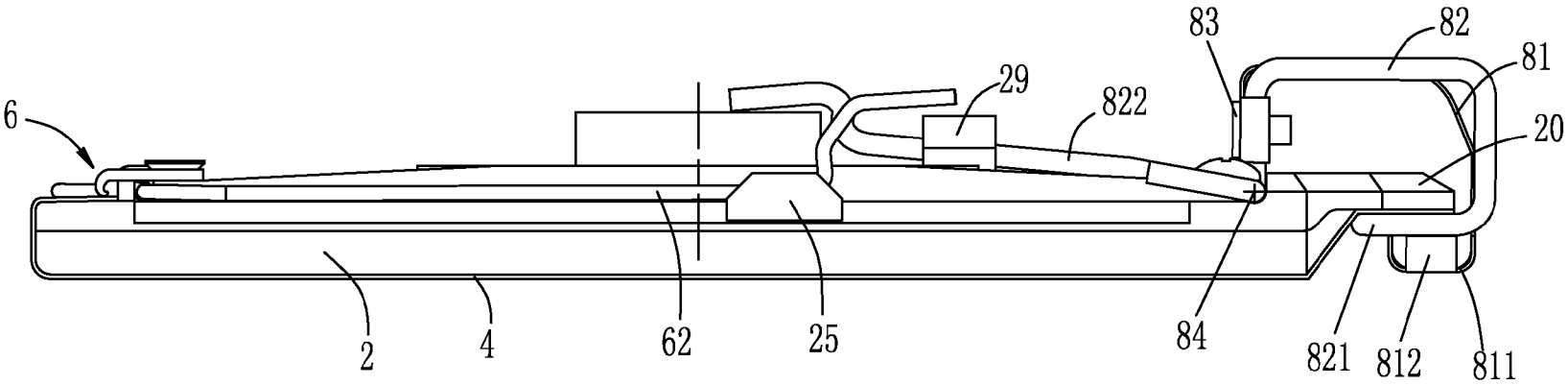
FIG. 7 is a schematic view illustrating the clamping mechanism of FIG. 2 in a clamping and tensioning position.
Figure 8:
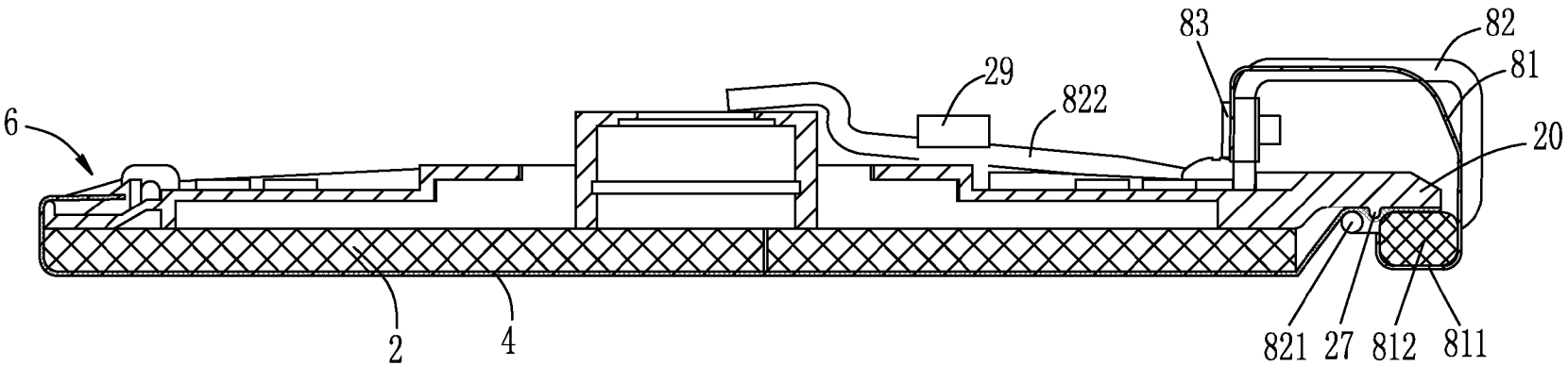
FIG. 8 is a sectional view of the clamping mechanism as shown in FIG. 7.

When the other end of the sand paper 4 is clamped, the end of the sand paper firstly passes over the projection 27 and is inserted into the clearance between the second clamping portion 811 and the clamping area 20 of the bottom plate. Next, the second handle 822 is pivoted about the second pivot shaft 84, and accordingly, the clamping element 81 and the tensioning element 82 are driven together to pivot about the second pivot shaft axis 84. As shown in FIG. 5, during pivoting, the rubber strip 812 on the clamping element 81 contacts with the end of the sand paper firstly and presses it on the lower surface of the clamping area 20 so as to clamp the end of the sand paper. With the second handle 822 being further pivoted, the clamping force applied by the clamping element 81 on the end of the sand paper is increased. At the same time, the tensioning element 82 continues to move about the second pivot shaft axis 84 along an arcuate track A. The tensioning portion 821 of the tensioning element 82 contacts with the sand paper and pulls the sand paper upwardly and inclinedly. When the tensioning portion 821 is pivoted until it is stopped by the clamping area 20, the sand paper 4 is tensioned and the second handle 822 is engaged with the second locking block 29, in the tensioning condition as shown in FIGS. 7 and 8. In the clamping and tensioning conditions, the tensioned end of the sand paper is located between the second clamping portion 811 and the clamping area 20, and at the same time between the tensioning portion 821 and the clamping area 20. Because the clamping area 20 has no relative movement with the bottom plate 2 therebetween and has no elasticity, the vibration generated by the sanding machine during working will not cause the movement of the clamping area 20, which makes the clamping and tensioning of the sand paper more reliable. Additionally, the projection 27 on the clamping area 20 is located between the second clamping portion 811 and the tensioning portion 821 in the tensioning condition of the sand paper, which will prevent the tensioned sand paper from moving toward the other end of the sand paper.

The sanding machine disclosed by the present invention is not limited by the contents described above and the structure shown in the drawings. For example, the release-proof mechanism on the lower surface of the clamping area of the bottom plate could also be implemented by designing the lower surface of the clamping area as a tooth surface. Thus, it will be appreciated that obvious changes, substitution, and modification to the shapes and locations of parts described herein will be within the scope of the present invention.

What is claimed is:

1. A sanding machine, comprising:

a housing;

a bottom plate mounted under the housing, the bottom plate having an upper surface and a lower surface for supporting a burnishing element, the lower surface having a stationary recess formed in the lower surface proximate an end of the bottom plate, and including a projection extending along a length of the recess thereby dividing the recess into a clamping area proximate the end of the bottom plate and a tensioning area distant from the end of the bottom plate; and a clamping mechanism positioned at the end of the bottom plate for clamping and tensioning the burnishing element, wherein the clamping mechanism comprises:

a generally U-shaped tensioning element pivotally mounted to the upper surface of the bottom plate and extending around the end of the bottom plate and towards the lower surface of the bottom plate such that pivotal movement of the tensioning element causes the tensioning element to contact the tensioning area of the lower surface; and a generally U-shaped flexible spring clamping element separately formed from the tensioning element and coupled to the tensioning element for pivotal movement therewith, the clamping element extending from the upper surface of the bottom plate around the end of the bottom plate and towards the lower surface of the bottom plate such that pivotal movement of the clamping element causes an end of the clamping element to contact the clamping area of the lower surface, wherein the tensioning element has a longer operational length along the lower surface of the bottom plate than the clamping element, such that when both the tensioning element and the clamping element are pivoted, the clamping element contacts the burnishing element against the clamping area prior to the tensioning element contacting the burnishing element to move into contact with the tensioning area to cause the burnishing element to extend over the projection thereby causing tension of the burnishing element to increase.

2. The sanding machine of claim 1, wherein said clamping element is connected with the tensioning element via fasteners.

3. The sanding machine of, wherein the lower surface of the recess forming the clamping area is above the lower surface of the bottom plate.

4. The sanding machine of claim 1, wherein the tensioning element comprises a bent steel wire.

5. A sanding machine, comprising:

a housing;

a bottom plate mounted under the housing, the bottom plate having an upper surface and a lower surface for supporting a burnishing element, the lower surface having a stationary recess formed in the lower surface proximate an end of the bottom plate, and the recess being divided into a clamping area proximate the end of the bottom plate and a tensioning area distant from the end of the bottom plate; and a clamping mechanism associated with the bottom plate, wherein the clamping mechanism comprises; and a generally U-shaped tensioning element pivotally mounted to the upper surface of the bottom plate and extending around the end of the bottom plate and towards the lower surface of the bottom plate such that pivotal movement of the tensioning element causes the tensioning element to contact the tensioning area of the lower surface; and a generally U-shaped flexible spring clamping element separately formed from the tensioning element and coupled to the tensioning element for pivotal movement therewith about a common axis, the clamping element extending from the upper surface of the bottom plate around the end of the bottom plate and towards the lower surface of the bottom plate such that pivotal movement of the clamping element causes an end of the clamping element to contact the clamping area of the lower surface, the tensioning element having a longer operational length than the clamping element, such that when the clamping element and the tensioning element are pivoted about the common axis, the clamping element contacts the burnishing element against the clamping area prior to the tensioning element contacting the burnishing element to move into the tensioning area of the recess to cause the tension of the burnishing element to increase, and wherein the ends of the burnishing element are supported directly on the clamping area when the burnishing element is placed into tension by the tensioning element.

6. The sanding machine of claim 5, wherein the clamping mechanism comprises a first clamping mechanism and a second clamping mechanism positioned at two ends of the bottom plate, respectively, and wherein the second clamping mechanism comprises the clamping element and the tensioning element.

7. The sanding machine of claim 5, wherein the clamping element is connected with the tensioning element via a fastener.

8. The sanding machine of claim 7, wherein the tensioning element comprises a bent steel wire.

* * * * *